US007374238B2

(12) United States Patent
Lingwall

(10) Patent No.: US 7,374,238 B2
(45) Date of Patent: May 20, 2008

(54) PORTABLE COVERED SEATING APPARATUS

(76) Inventor: Eric B. Lingwall, 3448 S. 8280 W., Magna, UT (US) 84044

( * ) Notice: Subject to any disclaimer, the term of this patent is extended or adjusted under 35 U.S.C. 154(b) by 0 days.

(21) Appl. No.: 10/908,599

(22) Filed: May 18, 2005

(65) Prior Publication Data

US 2006/0261643 A1 Nov. 23, 2006

(51) Int. Cl.
*A47C 7/62* (2006.01)
*A47C 4/00* (2006.01)

(52) U.S. Cl. ..... 297/184.11; 297/184.15; 297/17; 297/129

(58) Field of Classification Search ..... 297/118, 297/129, 184.1, 184.11, 184.15, 440.1, 440.14, 297/17
See application file for complete search history.

(56) References Cited

U.S. PATENT DOCUMENTS

| | | | | | |
|---|---|---|---|---|---|
| 33,398 | A * | 10/1861 | Miller | 190/2 |
| 2,738,249 | A * | 3/1956 | Louis | 312/237 |
| 3,179,465 | A * | 4/1965 | Roberts | 297/17 |
| 3,544,157 | A * | 12/1970 | Muller | 297/118 |
| 4,086,931 | A | 5/1978 | Hall | |
| 4,641,883 | A * | 2/1987 | Kato | 297/184.15 |
| 4,930,838 | A | 6/1990 | Brabant | |
| 5,002,080 | A | 3/1991 | Ma | |
| D329,761 | S | 9/1992 | Pieper | |
| 5,287,872 | A | 2/1994 | Anderson | |
| 5,299,337 | A * | 4/1994 | Venza | 5/656 |
| 5,551,558 | A * | 9/1996 | Bureau | 206/223 |
| 5,582,458 | A * | 12/1996 | Wildt | 297/184.15 |
| 5,611,414 | A * | 3/1997 | Walker | 190/2 |
| 5,727,844 | A * | 3/1998 | O'Quinn et al. | 297/217.1 |
| 5,927,310 | A | 7/1999 | Lin | |
| 6,230,727 | B1 | 5/2001 | Chen | |
| 6,244,286 | B1 | 6/2001 | Russo | |
| 6,296,002 | B1 * | 10/2001 | Tashchyan | 135/96 |
| 6,474,097 | B2 * | 11/2002 | Treppedi et al. | 62/457.7 |
| 2004/0129184 | A1 | 7/2004 | Kraker | |
| 2005/0039260 | A1 * | 2/2005 | Tyler | 5/417 |
| 2005/0067864 | A1 * | 3/2005 | Anglin | 297/217.1 |

* cited by examiner

*Primary Examiner*—Sarah B McPartlin
(74) *Attorney, Agent, or Firm*—Dale J. Ream

(57) ABSTRACT

A portable seating apparatus includes a storage box having upwardly extending sidewalls, a seat cushion pivotally mounted in the storage box, and a framework for providing portable seating and protection from weather elements. A covering is connected to the framework. The framework is completely stored within the storage box and the seat cushion may be hingedly attached to the storage box. The framework may be adjustable. The apparatus may also provide a plurality of legs and sidewalls. The apparatus may further provide a storage pocket in the storage box.

12 Claims, 5 Drawing Sheets

PORTABLE COVERED SEATING APPARATUS

BACKGROUND AND SUMMARY OF THE INVENTION

This invention relates generally to portable covered seating apparatuses, and, more specifically, to a portable covered seating apparatus that may be self contained, and self standing.

Outdoor events, like concerts and sporting contests, require spectators to sit for extended periods of time. These extended periods of time sometimes include undesirable weather conditions, like snow, rain, sleet, and sometimes too much sun. When the weather conditions are undesirable, they often ruin the event for many spectators.

Further, the provided seating is often less than desirable to spend extended periods of time sitting on. After a long period sitting on uncomfortable seating, spectators may become sore, irritable, and generally uncomfortable. Stadiums and arenas often provide seat cushions; however, the seat cushions currently available in the prior art offer no protection from the weather conditions.

Often, spectators attempt to use hand held umbrellas to alleviate the discomfort caused by the weather conditions. Although assumably effective for their intended purposes, hand held umbrellas can be too flimsy. Additionally, the spectator must hold the hand held umbrella. Therefore, the umbrella cannot effectively and efficiently protect the spectator from the severe weather conditions. Finally, the umbrella can block the views of other spectators. In sum, hand held umbrellas can add to the discomfort and inconvenience rather than alleviate the same.

The present invention overcomes both of these problems, as well as other problems associated with outdoor event seating. The present invention provides a comfortable seating cushion, to alleviate the discomfort caused by the long periods spent sitting on uncomfortable stadium seating. The present invention also contains a free standing cover, to provide for protection from the elements, without adding to the discomfort of the spectator and may be collapsed into a self-contained storage that may easily be carried by the spectator.

SUMMARY OF THE INVENTION

A portable seating apparatus according to the present invention includes, generally, a seat cushion, a storage box and the umbrella covering. The seat cushion has features similar to those seat cushions that stadiums provide to spectators. A variety of materials may be used for the seat cushion such as, soft pliable plastic, cotton, denim, leather and other cloths. Further, the seat cushion may include a conventional stuffing material such as cotton, polyester, synthetic fibers, or the like.

The seat cushion may be hingedly attached to the storage box. The storage box houses the umbrella covering when the umbrella covering is in the lowered configuration. The storage box may also have additional storage space for storing other items. The storage box may be constructed of conventional materials, like metals, metalloids, metal alloys, synthetics, plastics, or even wood.

The storage box houses the umbrella covering, when the umbrella covering is not in use. The umbrella covering includes a covering material and a frame. The covering material creates the area around the seat cushion where the user is protected from the elements. This may include cotton, canvas, vinyl, nylon, polyester, or a blend of the previously mentioned materials. The fabric composing the covering should be at least slightly stretchable and adequately waterproof.

The second element of the umbrella covering is the frame. The frame utilizes poles to define the boundaries of the covered area. The poles can be flexible fiberglass poles and rigid plastic poles. Poles composed of flexible fiberglass could bend and define the covered area, while poles made of rigid plastic, like PVC, would require joints to connect the poles and define the covered area.

Therefore, a general object of this invention is to provide a seating apparatus that is portable and may be carried between a vehicle and spectator event.

Another object of this invention is to provide a seating apparatus, as aforesaid, that includes umbrella elements that may be selectively extended and retracted.

Still another object of this invention is to provide a seating apparatus, as aforesaid, that is portable and self containing, allowing the entire apparatus to be internally stored and easily transportable.

Yet another object of this invention is to provide a seating apparatus, as aforesaid, that further protects a user from the weather by utilizing laterally opposed sidewalls.

A further object of this invention is to provide a seating apparatus, as aforesaid, that is self standing, allowing the entire apparatus to stand independently when no stadium seating is provided.

A still further object of this invention is to provide a seating apparatus, as aforesaid, that allows a user to create a plurality of covered area sizes by utilizing frames that may be adjusted.

A further object of this invention is to provide a seating apparatus, as aforesaid, that includes a handle to allow for easier transport.

A further object of this invention is to provide a seating apparatus, as aforesaid, that utilizes additional storage space so that the user may store additional items.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
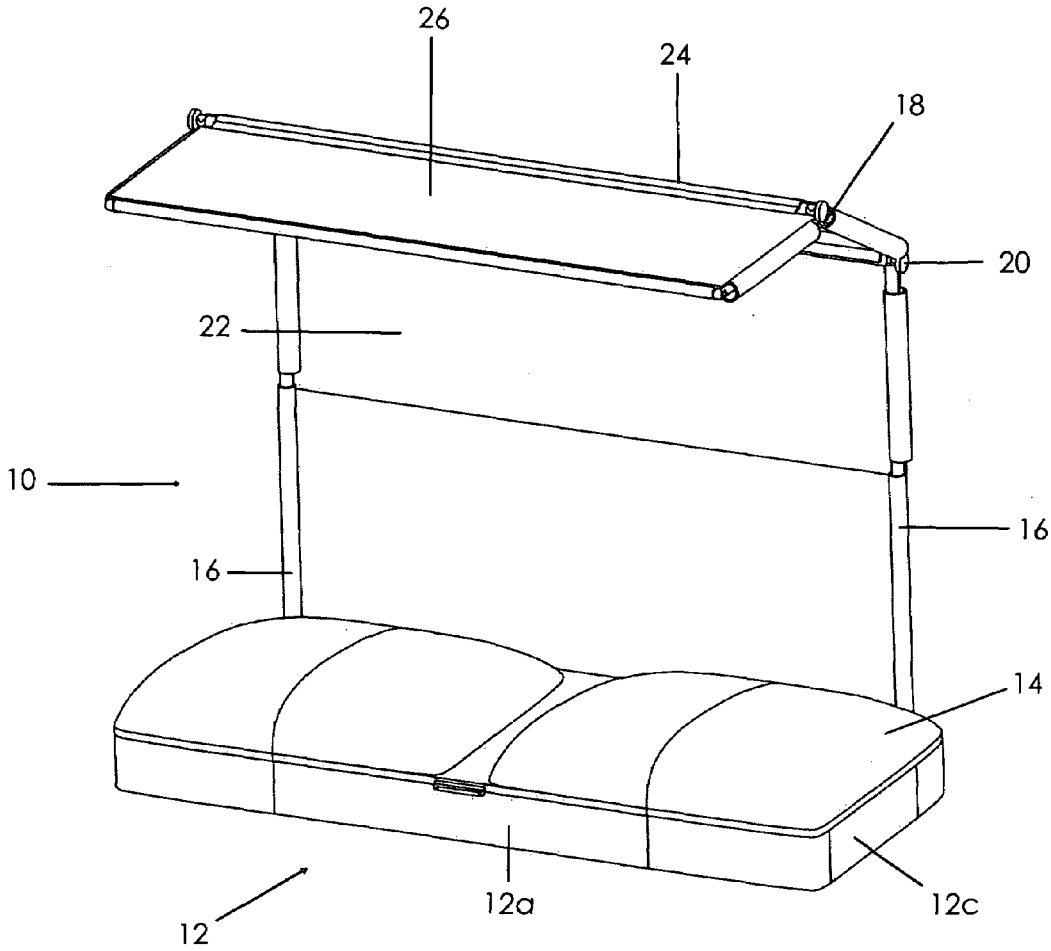
FIG. 1 is a perspective view of a portable seating apparatus according to one embodiment of the present invention.
Figure 2:
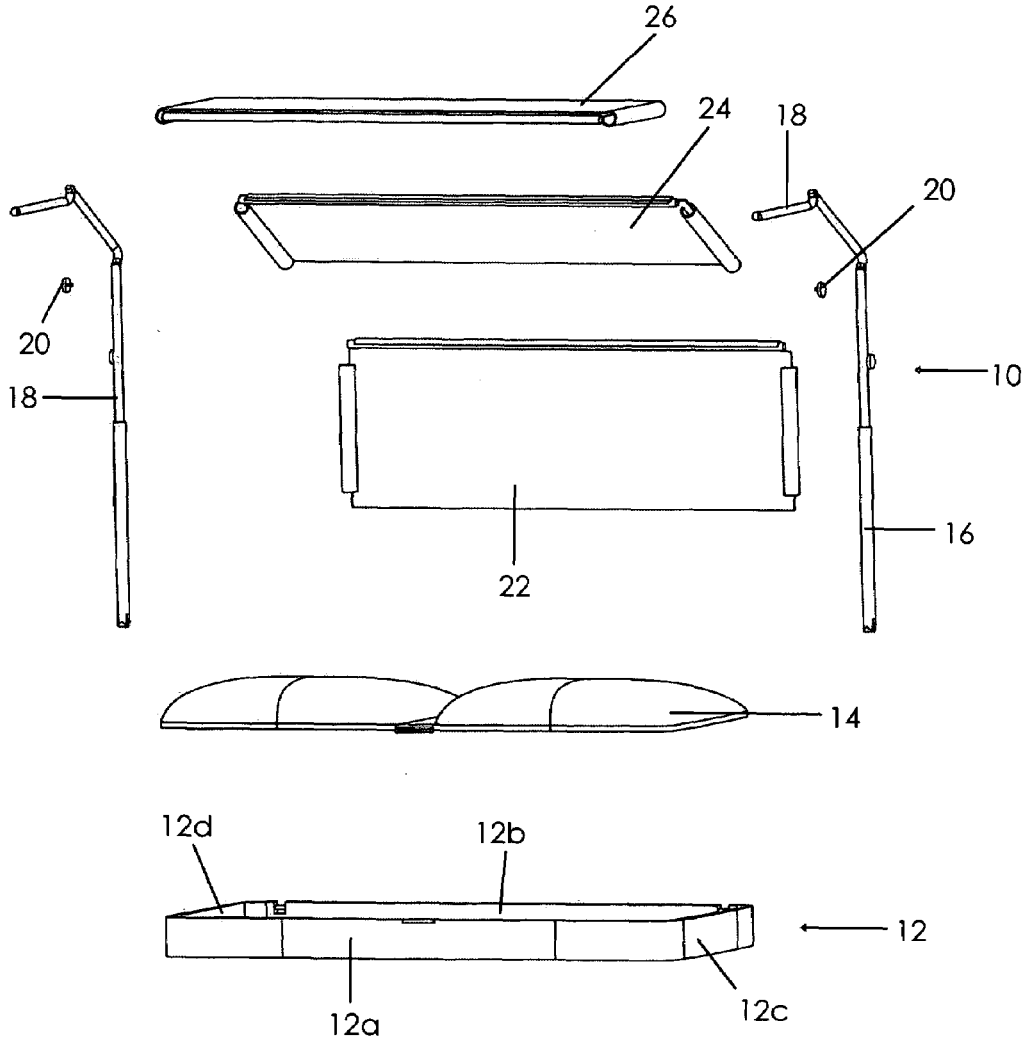
FIG. 2 is an exploded view of the seating apparatus as in FIG. 1.

A portable seating apparatus according to the present invention will now be described in detail with reference to FIGS. 1 through 5 of the accompanying drawings. More particularly, a portable seating apparatus 10 according to one embodiment of the invention is shown in FIGS. 1 to 3*d* and includes a seat box 12, a seat cushion 14, telescoping frame poles 16, hinged rods 18, adjustment knobs 20, a back panel 22, a middle panel 24 and a top panel 26. The seat box 12 includes opposed front 12*a* and rear 12*b* sidewalls with lateral opposed sidewalls 12*c*, 12*d* extending therebetween (FIG. 2).

Figure 3A:
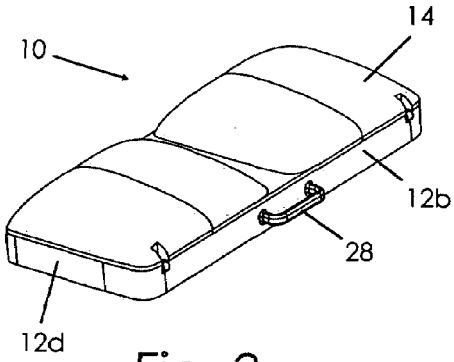
FIGS. 3*a*-3*d* are perspective views of the seating apparatus in various configurations from a storage or retracted configuration to a fully extended configuration.
Figure 3B:
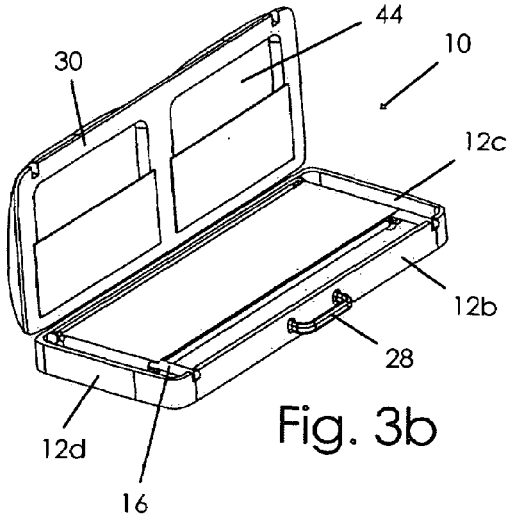
Figure 3C:
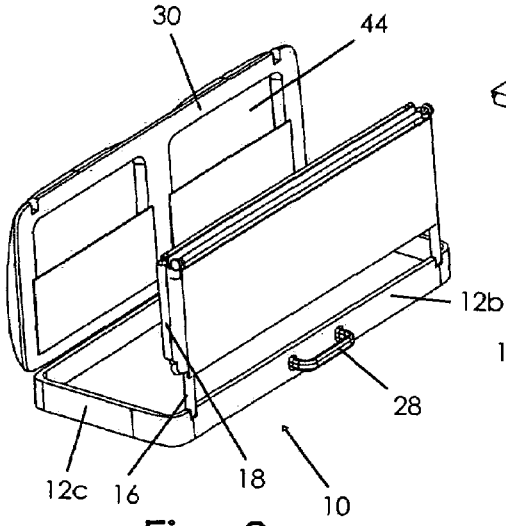
Figure 3D:
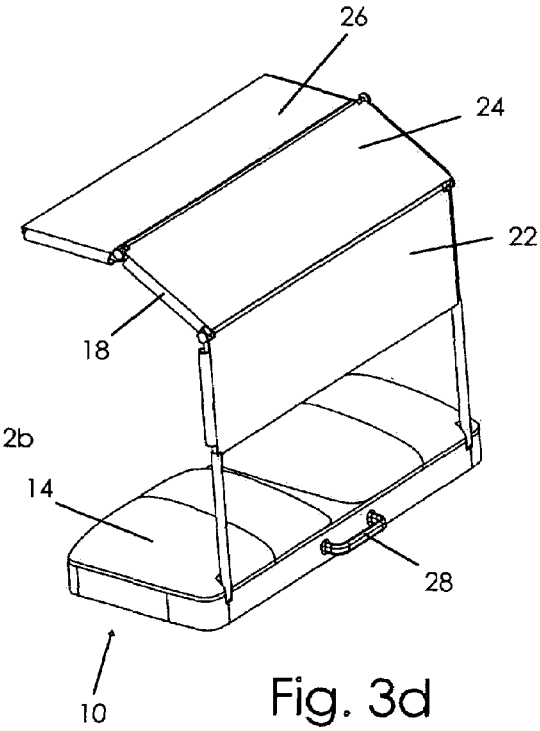

The seat cushion 14 is hingedly coupled to the front sidewall 12*a* of the seat box 12 and, more particularly, to the rear sidewall 12*b* thereof. The telescoping frame poles 16 may also be hingedly attached to the rear sidewall 12*b* of the seat box 12 (FIGS. 3*c* and 3*d*). The back panel 22 is functionally attached to the adjustable section of the telescoping frame poles 16. The hinged rods 18 may also connect to the telescoping frame poles 22.

The position of the hinged rods 18 may be adjustable because of the adjustment knobs 20. The user selects the height and angle of the hinged rods 18 and then tightens the adjustment knob 20 by turning it and locking the position of the hinged rods 18 in place. There are other means for holding the hinged rods 18 in a user-selectable position relative to the telescoping frame poles 16. These other means can be a self locking joint, a self locking joint with a push button, the use of attachment collars and other suitable fasteners.

The middle panel 24 and top panel 26 are functionally attached to the hinged rods 18 (FIG. 3*d*). The middle panel 24, top panel 26 and back panel 22 cooperate to protect the user from undesirable weather conditions. It is also preferred that the middle panel 24, back panel 22, and top panel 26 have overlapping sections. These overlapping sections will allow a user to create a substantially continuous and uniform barrier from the elements.

In use, the portable seating apparatus 10 may be carried by its handle 28 from a storage location or vehicle to the desired spectator event, e.g. a football game. Then, the seat cushion 14 may be moved from the lowered configuration (FIG. 3*a*) to the raised configuration (FIG. 3*b*).

If the seat cushion 14 is in the raised configuration (FIG. 3*a*) the telescoping poles 16 may be moved from the lowered configuration (FIG. 3*b*) to the raised configuration (FIG. 3*c*). After moving the telescoping poles 16 to the raised configuration (FIG. 3*c*), the seat cushion 14 may be lowered back to the lowered configuration (FIG. 3*d*).

In the raised configuration (FIG. 3*c*) the telescoping poles 16 may be moved from their compressed configuration (FIG. 3*c*) to the expanded configuration (FIG. 3*d*). While the telescoping poles are in the expanded configuration (FIG. 3*d*), the hinged rods 18 may be moved from the folded configuration (FIG. 3*c*) to the unfolded configuration (FIG. 3*d*).

In the unfolded configuration (FIG. 3*d*), the hinged rods 18 may be positioned in user-selectable configurations. The preferred means for holding the hinged rods 18 in a user-selectable position relative to the telescoping frame poles 16 is through the use of the adjustment knob 20 (FIG. 4*b*). When the hinged rods 18 are in the position the user requires, the adjustment knob 20 is tightened by turning the adjustment knob 20 and securely holding the hinged rods 18 in place (FIGS. 4*a* and 4*b*).

The entire process may be reversed to collapse the portable seating apparatus 10. The adjustment knob 20 may be loosened to lower the hinged rods 18 from the unfolded position (FIG. 3*d*) to the hinged rods' 18 folded position (FIG. 3*c*). Then, the telescoping poles 16 may be moved from the expanded position (FIG. 3*d*) to the compressed position (FIG. 3*c*). The seat cushion 14 may then be moved from the lowered configuration (FIG. 3*d*) to the raised configuration (FIG. 3*c*). The telescoping poles 16 may then be moved from their raised configuration (FIG. 3*c*) to their lowered configuration (FIG. 3*b*). Finally, the seat cushion 14 may be returned to the lowered configuration (FIG. 3*a*), and the entire portable seating apparatus 10 may be easily transported using a handle 28 connected to the rear sidewall 12*d* of the seat box 12 (FIG. 3*d*).

Figure 4A:
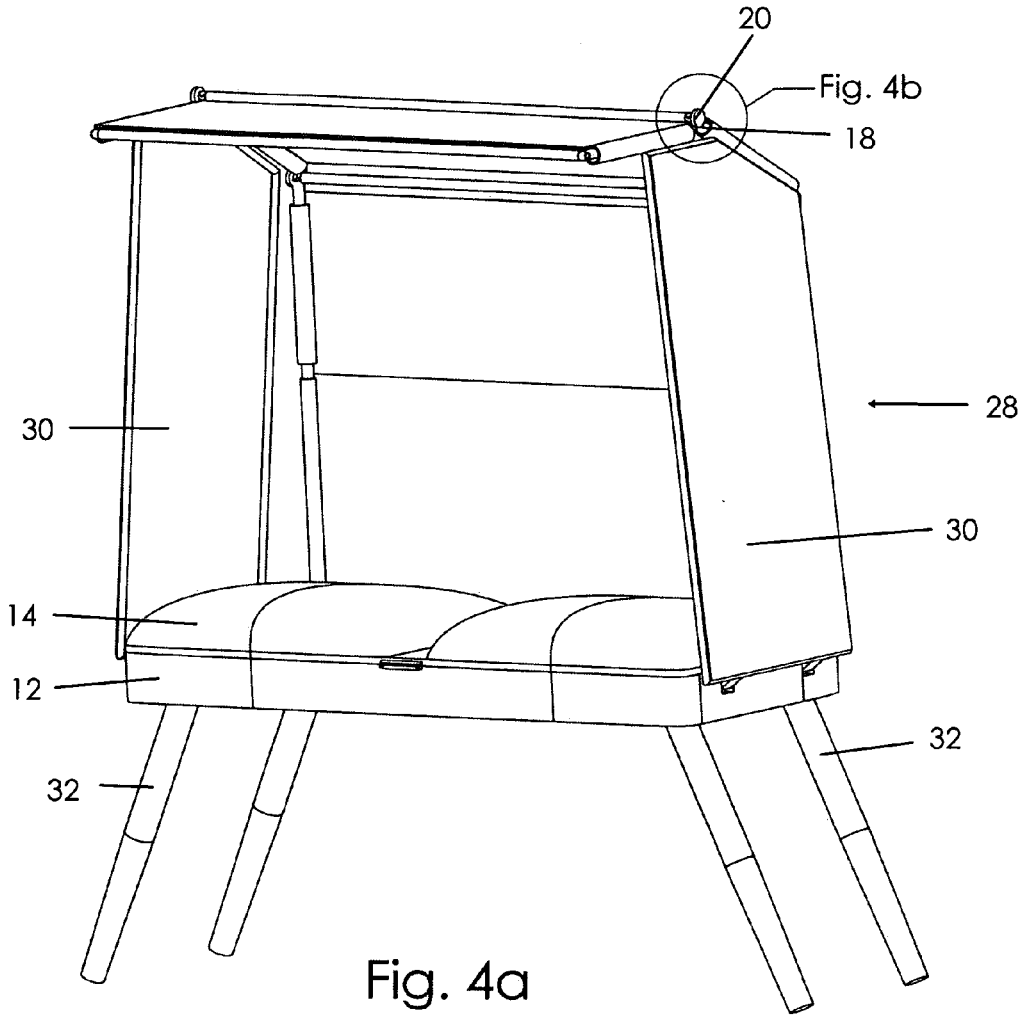
FIG. 4*a* is a perspective view of a portable seating apparatus according to another embodiment of the present invention.
Figure 4B:
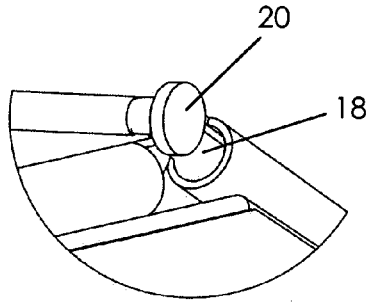
FIG. 4*b* is an isolated perspective view on an enlarged scale of the element labeled FIG. 4*b* in FIG. 4*a;*

A portable seating apparatus 28 according to another embodiment of the present invention is shown in FIG. 4*a* and FIG. 4*b* and includes a construction substantially similar to the construction of the first embodiment of a portable seating apparatus 10 first described above except as specifically described below. Specifically, the portable seating apparatus 28 according to this alternative embodiment includes sidewalls 30 and legs 32.

More particularly, the sidewalls 30 may be pivotally attached to the seat box 12. The sidewalls 30 may be pivotally moved from a lowered configuration and to raised configuration. The sidewalls 30 may utilize the methods previously mention for changing from the lowered configuration to the raised configuration. When the seat cushion 14 is moved into the raised configuration (FIG. 3*b*), the sidewalls 30 may be pivoted from the lowered position to the raised position (FIG. 4*a*). The sidewalls 30 may be pivotally connected to laterally opposed sidewalls of the seat box 12 at.

Further, the apparatus includes legs 32 (FIG. 4*a*). The legs may be pivotally attached to a bottom panel of the seat box 12 opposite the seat cushion 14. The legs 32 may be adjustable from a retracted configuration to an extended configuration. By utilizing legs 30, the portable seating apparatus 28 may function as a self standing seat or self standing bench.

Figure 5:
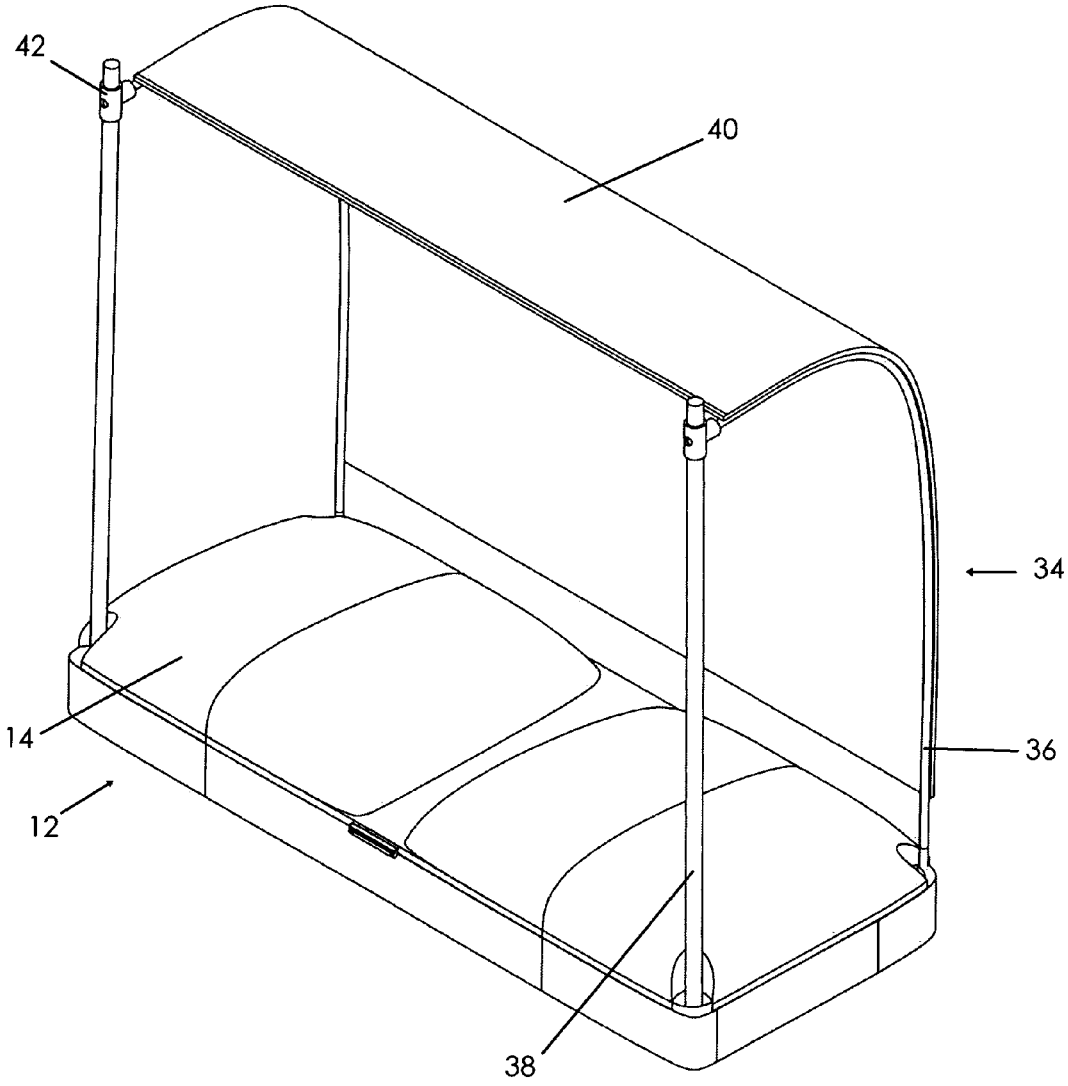
FIG. 5 is a perspective view of a seating apparatus according to still another embodiment of the present invention.

A portable seating apparatus 34 according to still another embodiment of the present invention is shown in FIG. 5. The construction of the seat cushion 14 and the seat box 12 is substantially similar to the constructions of the previous embodiments except as specifically described below. Specifically, this embodiment has a frame constructed of flexible back rods 36.

In use, the seat cushion 14 may be moved to the raised configuration as previously mentioned. When the seat cushion 14 is in the raised configuration (FIG. 3*b*), the flexible back rods 36 can be raised from the lower configuration to the raised configuration, similar to the telescoping poles 16, described in detail above. Similarly, a pair of support front rods 38 may be raised from the lowered configuration to the raised configuration.

A covering 40 is functionally attached to the flexible back rods 36. The covering 40 functions similarly to the back panel 22, middle panel 24 and top panel 26 mentioned in detail above.

Each flexible back rod 36 is in communication with an attachment collar 42. The attachment collars 42 may be sized to movably fit around the front rods 38. The attachment collars 42 may be positioned by the user to a selected position.

In any of the previously mentioned embodiments, a pocket 44 may be provided on the bottom surface of the seat cushion 14 (FIGS. 3*b* and 3*c*). The pocket 44 may provide a user with additional storage space for storing items such as, sun block, toys, snacks, refreshments and other items commonly brought to outdoor events by spectators.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

It is understood that while certain forms of this invention have been illustrated and described, it is not limited thereto except insofar as such limitations are included in the following claims and allowable functional equivalents thereof.

What is claimed is:

1. A portable seating apparatus, comprising:

a storage box having a bottom panel with front and rear sidewalls extending generally upwardly from said bottom panel and defining an interior space;

a seat hingedly attached to said rear sidewall of said storage box and being movable between a lowered configuration at which said seat and said bottom panel enclose said interior space and a raised configuration, said seat including a top surface having a cushion construction and a bottom surface defining a pocket;

a framework coupled to said storage box adjacent said rear sidewall for movement between a first configuration in which said framework is inside said storage box interior space and a second configuration in with said framework forms a roof over said storage box;

wherein said framework is movable from said first configuration in said interior space to said second configuration only when said seat is at said raised configuration;

wherein said storage box interior space is enclosed by said seat when said seat is at said lowered configuration;

a covering spanning said framework;

a plurality of legs coupled to said storage box for selectively raising said storage box;

wherein said framework comprises:

a pair of laterally spaced apart length-adjustable back rods, each back rod defining a longitudinal rod axis and presenting opposed first and second ends, each back rod including a first rod element and a second rod element telescopically received in said first rod element and movable along said respective rod axis for adjusting a length of said respective back rod, each said back rod first end being pivotally attached to said storage box;

a pair of roof rods presenting respective first and second ends, each said roof rod first end being pivotally attached to a respective back rod second end for movement between a folded configuration and an unfolded configuration;

wherein each said back rod includes an adjustment knob for holding said respective second rod element in a user-selectable position relative to said first rod element.

2. The portable seating apparatus as in claim 1, wherein said storage box has opposed lateral sidewalls, said apparatus further comprising a side panel coupled to said storage box adjacent one said lateral sidewall for movement between a first configuration in which said side panel is inside said storage box interior space and a second configuration in which said side panel is substantially vertical.

3. The portable seating apparatus as in claim 1, wherein said covering includes a waterproof material.

4. The portable seating apparatus as in claim 1, wherein said legs are pivotally coupled to said storage box for movement between a retracted configuration and an extended configuration.

5. The portable seating apparatus as in claim 1, further comprising a handle coupled to said storage box adjacent said rear sidewall.

6. The portable seating apparatus as in claim 1, wherein each said back rod includes means for holding said respective second rod element in a user-selectable position relative to said first rod element.

7. The portable seating apparatus as in claim 1, wherein each said roof rod includes means for holding said respective roof rod in a user-selectable position relative to said respective back rod.

8. The portable seating apparatus as in claim 1, wherein:

a said framework further comprises a pair of outer rods presenting respective first and second ends, each said outer rod first end being pivotally attached to a respective roof rod second end for movement between a closed configuration and an open configuration; and each said outer rod includes means for holding said respective outer rod in a user-selectable position relative to said respective roof rod.

9. The portable seating apparatus as in claim 8, wherein said storage box has opposed lateral sidewalls, said apparatus further comprising:

a side panel coupled to said storage box adjacent one said lateral sidewall for movement between a first configuration in which said side panel is inside said storage box interior space and a second configuration in which said side panel is substantially vertical; and a plurality of legs coupled to said storage box for selectively raising said storage box.

10. The portable seating apparatus as in claim 1, wherein said framework comprises:

a pair of laterally spaced apart front rods, each front rod presenting a first end attached to said storage box adjacent said front sidewall and a second end attachable to a respective back rod second end.

11. The portable seating apparatus as in claim 10, wherein said framework further comprises a pair of attachment collars, each said attachment collar attaching a respective back rod second end to a respective front rod second end.

12. The portable seating apparatus as in claim 11, wherein said storage box has opposed lateral sidewalls, said apparatus further comprising a side panel coupled to said storage box adjacent one said lateral sidewall for movement between a first configuration in which said side panel is inside said storage box interior space and a second configuration in which said side panel is substantially vertical.

* * * * *